US009187925B2

(12) United States Patent
Esarey et al.

(10) Patent No.: US 9,187,925 B2
(45) Date of Patent: Nov. 17, 2015

(54) TENT STAKE WITH ILLUMINATION

(71) Applicant: Industrial Revolution, Inc., Tukwila, WA (US)

(72) Inventors: Graeme Esarey, Seattle, WA (US); Jami Odell, Des Moines, WA (US)

(73) Assignee: Industrial Revolution, Inc., Tukwila, WA (US)

( * ) Notice: Subject to any disclaimer, the term of this patent is extended or adjusted under 35 U.S.C. 154(b) by 0 days.

(21) Appl. No.: 14/170,504

(22) Filed: Jan. 31, 2014

(65) Prior Publication Data

US 2014/0261598 A1 Sep. 18, 2014

Related U.S. Application Data

(60) Provisional application No. 61/793,814, filed on Mar. 15, 2013.

(51) Int. Cl.
*E04H 15/62* (2006.01)

(52) U.S. Cl.
CPC ..... *E04H 15/62* (2013.01)

(58) Field of Classification Search
CPC ..... E04H 15/62; E04H 12/2215; E04H 17/22
USPC ..... 135/118, 91, 120.4; 52/155–156; 119/786, 787, 791; 362/183, 249.05, 362/431
See application file for complete search history.

(56) References Cited

U.S. PATENT DOCUMENTS

| | | | | |
|---|---|---|---|---|
| 4,996,636 | A * | 2/1991 | Lovett | 362/431 |
| 5,036,447 | A * | 7/1991 | Taylor | 362/431 |
| 5,044,597 | A * | 9/1991 | Walczak | 248/530 |
| 5,055,984 | A * | 10/1991 | Hung et al. | 362/183 |
| 5,176,354 | A * | 1/1993 | Feigenbaum, Jr. | 248/508 |
| 5,211,470 | A * | 5/1993 | Frost et al. | 362/183 |
| 5,526,243 | A * | 6/1996 | Masters | 362/122 |
| 7,025,311 | B1 * | 4/2006 | Gretz | 248/156 |
| 2003/0084620 | A1 * | 5/2003 | Benincasa et al. | 52/155 |
| 2003/0234334 | A1 * | 12/2003 | Kenney | 248/530 |
| 2005/0128738 | A1 * | 6/2005 | Parker et al. | 362/184 |
| 2011/0121982 | A1 * | 5/2011 | Hansen | 340/604 |
| 2012/0140453 | A1 * | 6/2012 | Lin | 362/119 |

* cited by examiner

*Primary Examiner* — Winnie Yip
(74) *Attorney, Agent, or Firm* — DWC Law Firm, P.S.; David Chen

(57) ABSTRACT

A tent stake has a lighting component. A portion of the lighting component can be disposed between walls of the tent stake, and slidably attached thereto. The lighting component can have a lens attached to a flexible housing of the lighting component. A light source of the lighting component can be actuated by manually depressing the lens, with the lens floating on the housing. Also, in some embodiments, the lens can be pressed multiple times to select different lighting modes.

17 Claims, 8 Drawing Sheets

TENT STAKE WITH ILLUMINATION

CROSS REFERENCE TO RELATED APPLICATION(S)

This application claims the benefit of U.S. provisional patent application Ser. No. 61/793,814 (filed Mar. 15, 2013) which is incorporated herein by reference in its entirety.

BACKGROUND

1. Technical Field

The present disclosure relates to tent stakes for use in securing tent structures, and in particular, to tent stakes have illumination capabilities.

2. Description of Related Art

Assembly of tents often includes using tent stakes (or pegs) to anchor the tent to the ground. Tent stakes are typically constructed as a spike-like structure, made of metal, wood, plastic, or composite material, and can be driven into the ground and attached to the sheet material of the tent, or to ropes (or cords) attached to the tent.

DETAILED DESCRIPTION

Figure 1:
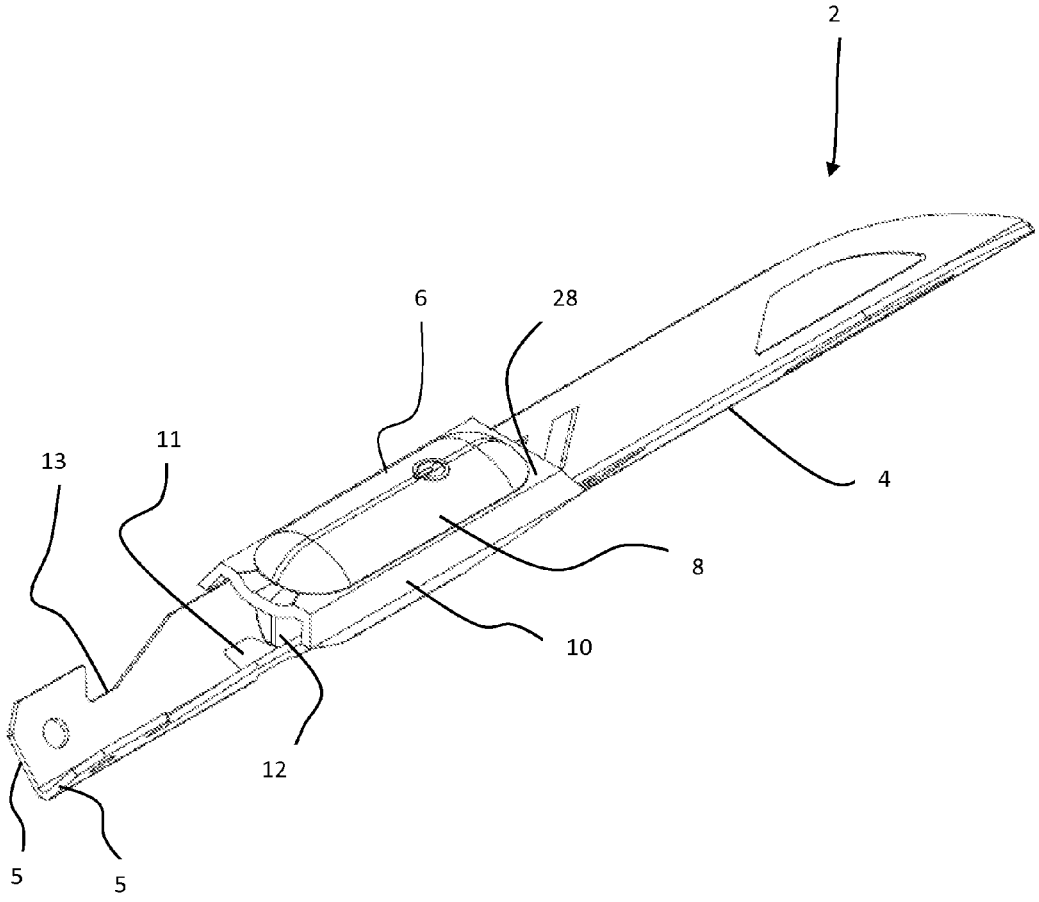
FIG. 1 is a perspective view showing an embodiment of a tent stake of the present disclosure.
Figure 2:
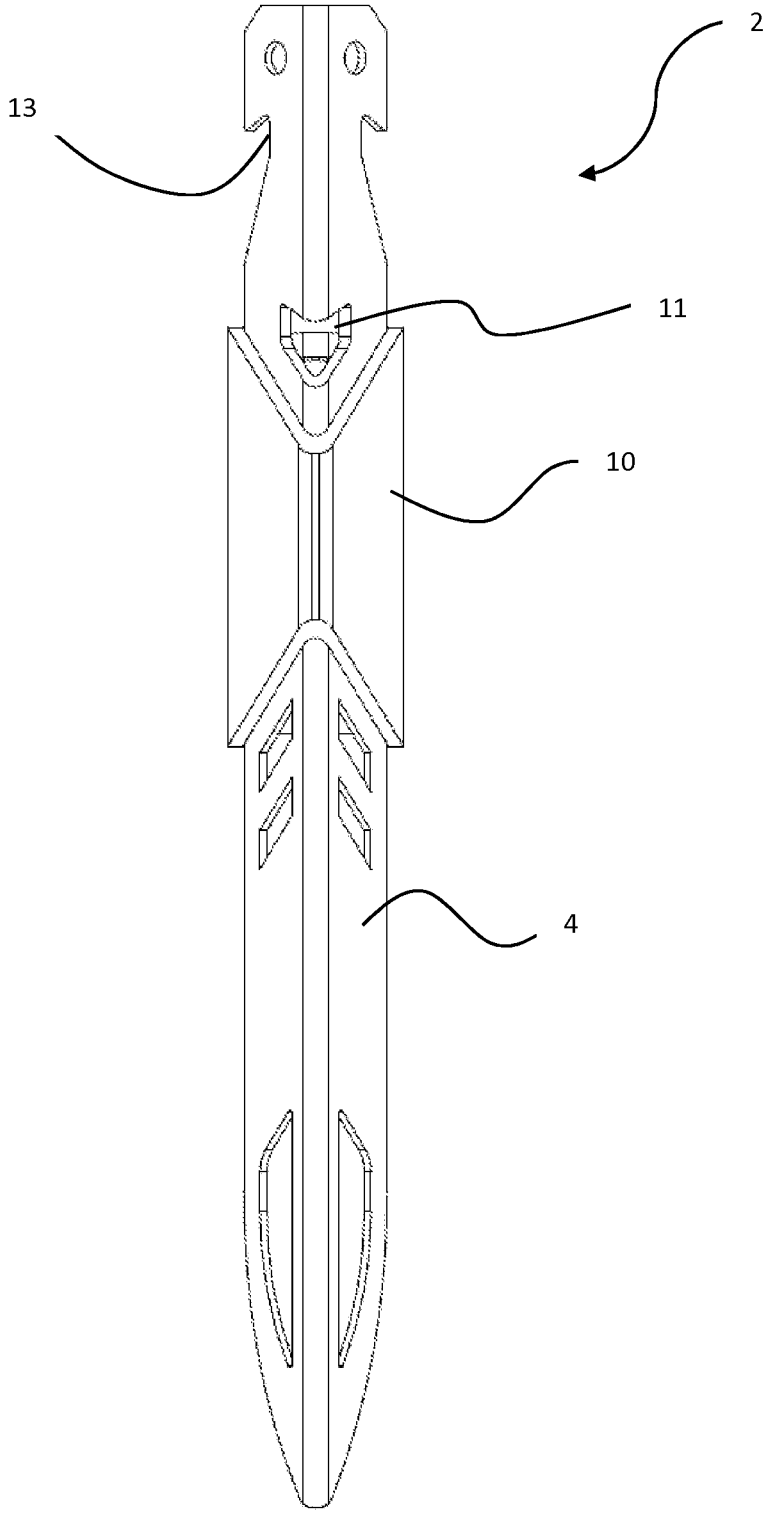
FIG. 2 is a back side plan view of the tent stake of FIG. 1.

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials associated with tents and tent stakes, switches, LEDs, and various materials of construction have not been described in detail to avoid unnecessarily obscuring the descriptions of the embodiments of the disclosure.

In the present disclosure, to the extent the terms "about" and "approximately" are used, they mean ±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, which terms and variants thereof are intended to be construed as non-limiting. The definitions in this paragraph are intended to apply throughout this disclosure unless otherwise expressly stated.

Various embodiments in this disclosure are described in the context of use with tents. However, as will be understood by those skilled in the art after reviewing this disclosure, various other structures may be suitable for use with the disclosed tent stakes, such as, for example, tarps or other sheet material used to cover objects.

As best seen in FIGS. 1-4, in some embodiments, a tent stake 2 is provided, which includes a body portion 4, and a lighting component 6. The lighting component 6 can have a lens 8 and a housing 10.

The body portion 4 can be constructed of, for example, aluminum, but various other materials of construction may also be suitable. In some embodiments, the body portion 4 is formed in the shape of two longitudinally extending walls 5 that meet at an angle (e.g., without limitation, between 60 and 90 degrees) at inward joined lateral edge portions thereof. In manufacturing, the two walls can be formed by creating a centerline longitudinally extending single bend or crease (e.g., a bend that defines the inward lateral edge portions of the walls 5) within a workpiece material of construction (e.g., a metal), with various pre-formed (e.g., pre-cut) features.

The body portion 4 can have an upper hook-like notch section 13 at one end portion, with a lower hook-like notch section 11, formed just below the upper hook-like notch section 13. In addition, a pointed tip can be provided at an opposite end portion (for use in driving the tent stake 2 into a ground surface). Also, the body portion 4 can include further cut-out sections to, for example, reduce the weight of the tent stake 2, or provide decorative appeal, without compromising its structural integrity suitable for use.

Figure 3:
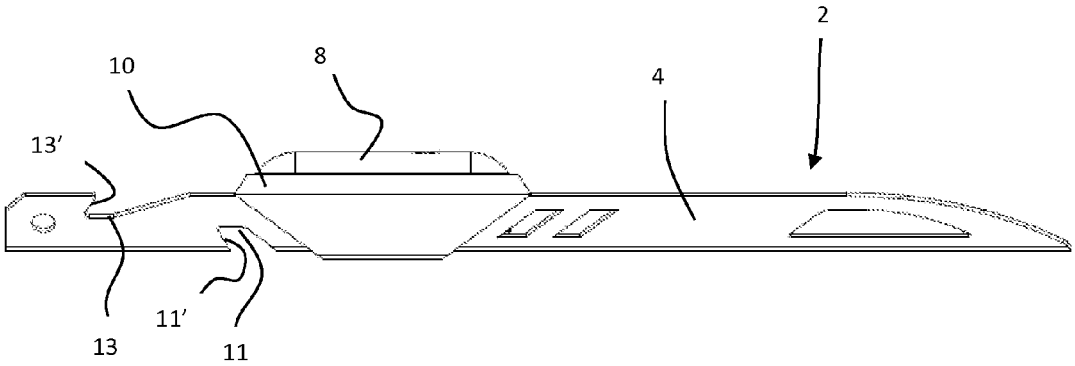
FIG. 3 is a side elevation view of the tent stake of FIG. 1.
Figure 4:
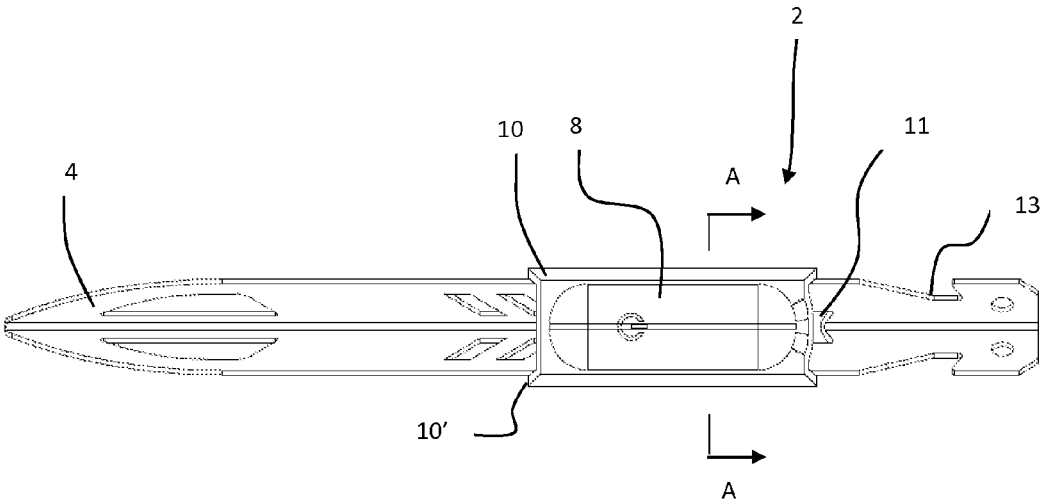
FIG. 4 is a front side plan view of the tent stake of FIG. 1.

As best seen in FIGS. 1 & 3, in some embodiments, the upper hook-like notch section 13 comprises two laterally aligned cut-outs, one on each longitudinal wall 5, opening on lateral outward edge portions of the longitudinal walls 5, with upper edges 13' of the cut-outs angled slightly downward as they extend outward, for use in securing a cord or other fastening member (as described further below).

As best seen in FIGS. 1 & 3, in some embodiments, the lower hook-like notch section 11 comprises a single cut-out, formed with a center thereof disposed at the joined edge portions of the longitudinal walls 5, without opening on lateral outward edge portions of the longitudinal walls 5, with an upper edge 11' of the cut-out angled slightly downward as it extends toward its centerline at the joined walls, for use in securing a cord or other fastening member (as described further below).

Figure 5:
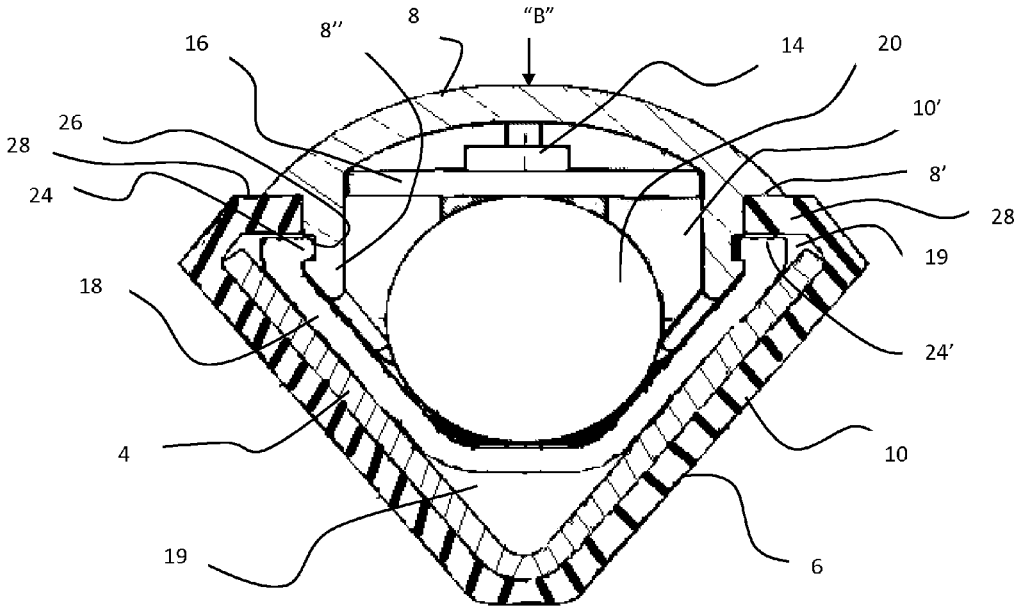
FIG. 5 is a cross-sectional view of the tent stake of FIG. 4, as viewed from line A-A in the direction of the arrows A-A as indicated in FIG. 4.

Referring to FIGS. 1 and 5, the lens 8 of lighting component 6, can be transparent or semitransparent, and house one or more LED(s) 14, which can be attached to a circuit board 16 to mechanically support and electrically connect the LEDs 14 to a switch structure. The LED(s) 14 can rest just beneath the lens 8, on the circuit board 16. Also, power to the LED(s) 14 can be supplied by a battery, such as, for example, a single AAA battery 20, housed within a battery cover 18, within the housing 10 of the lighting component 6.

In some embodiments, the lens 8 can be constructed of a thermoplastic polymer, such as, for example, polypropylene (PP) plastic. Also, the housing 10 and/or battery cover 18, can be constructed of, for example, a thermoplastic rubber or elastomeric material.

Referring to FIGS. 1 & 5, in some embodiments, the battery cover 18 and lens 8 are attached to the housing 10, by being snap fit together from above and below a ridge 28 of the housing 10. That is, for example, the lens 8 can have a base perimeter indent 26, extending along all or a part of its base perimeter, and the battery cover 18 can have a corresponding inwardly extending edge 24, that can be inserted into the indent 26. The base 8" of the lens 8 (having the perimeter indent 26) can be inserted into a top ("top," relative to FIG. 5), or forward facing, opening 10' of the housing 10, with downward ("downward," relative to FIG. 5) facing wall portions 8' of the lens 8 abutting against the top surface of the housing ridge 28. The perimeter indent 26 can be pressed into position between the inwardly extending edge 24 portions of the battery cover 18 below the housing ridge 28. That is, the battery cover 18 can have spring characteristics allowing its edge portions 24 to expand outward under pressure to allow a base 8" of the lens 8 to be pressed between the edge portions 24, then allowing the edge portions 24 to be biased inward into the perimeter indent 26 of the base 8" of the lens 8, to grip the base 8". A top surface 24' of the battery cover 18, or top of the edge portions 24, can abut against a downward ("downward," relative to FIG. 5) facing wall of the housing ridge 28, thus cooperatively working with the base 8" of the lens 8 to retaining the lens 8 and battery cover 18 attached to the housing 10.

The lens 8 can serve as a manually depressible switch, depressible from a resting position That is, for example, the lens 8 can be manually pressed (by pushing on its face), such as in the direction of arrow "B," in FIG. 5, and can float on the housing 10, the housing serving as a deformable spring, so that when the lens is depressed, a switch on the circuit board 16 can be contacted to activate or deactivate the LED(s) 14, as will be appreciated by those skilled in art after reviewing the present disclosure. The housing 10 can return the lens 8 to an original (e.g., resting) position after being depressed so that the lens 8 can be depressed again to switch the LED 14 off. However, in some embodiments, the LED 14 can have more than one mode. For example, the LED 14 can be switched on and provide continuous light in a "flood" mode, after a single press of the lens 8. When the lens 8 is depressed a second time, the LED 14 can be switched to a second mode, in which it flashes at a pre-set rate. When the lens 8 is depressed a third time, the LED 14 can be switched off.

In some embodiments, the housing 10 can be flexible and snuggly wrapped about an exterior portion of the walls 5 of the tent stake 2 body, as can be seen in FIGS. 1, 5. The housing 10 can be shorter in length along the centerline or bend between the walls 5 of the body portion 4, and longer near lateral edge portions of the walls 5.

The battery cover 18 can be disposed within the housing 10, but with a longitudinal gap 19 extending between the battery cover 18 and an inside wall surface of the housing 10, the longitudinal gap 19 opening on both end portions of the housing 10. The longitudinal gap 19 can be sized to snuggly accommodate the walls 5 of the tent stake body 4. The tent stake 2 body 4 can thus be inserted through the gap 19, between the housing 10 and the battery cover 18, to snuggly hold the lighting component 6 on the tent stake body 4, but to allow the lighting component 6 to be slidably movable along the length of the tent stake body 4, as shown by arrows "C" in FIGS. 6*a* & 7. That is, the lighting component 6 can be selectively manually positioned along the length of the tent stake body 4.

Figure 6B:
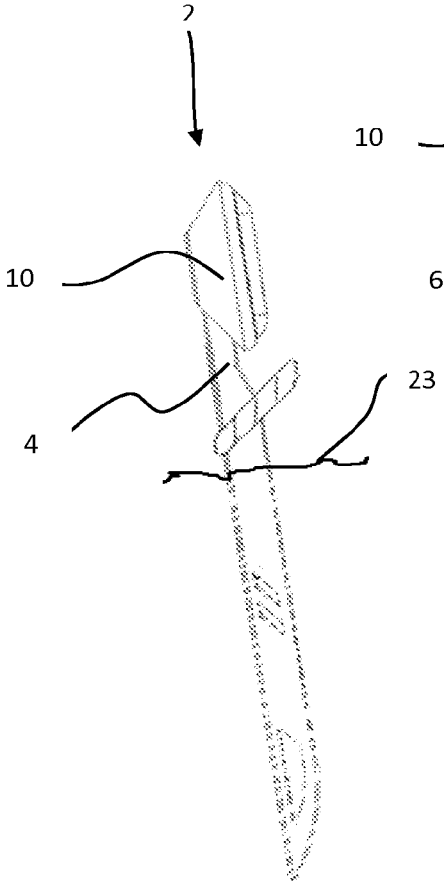
FIG. 6*b* is the tent stake of FIG. 1, showing the lighting component with housing having been slidably positioned on a top portion of the tent stake, so that the tent stake can be driving deeper into the ground than in FIG. 6*a*.
Figure 6A:
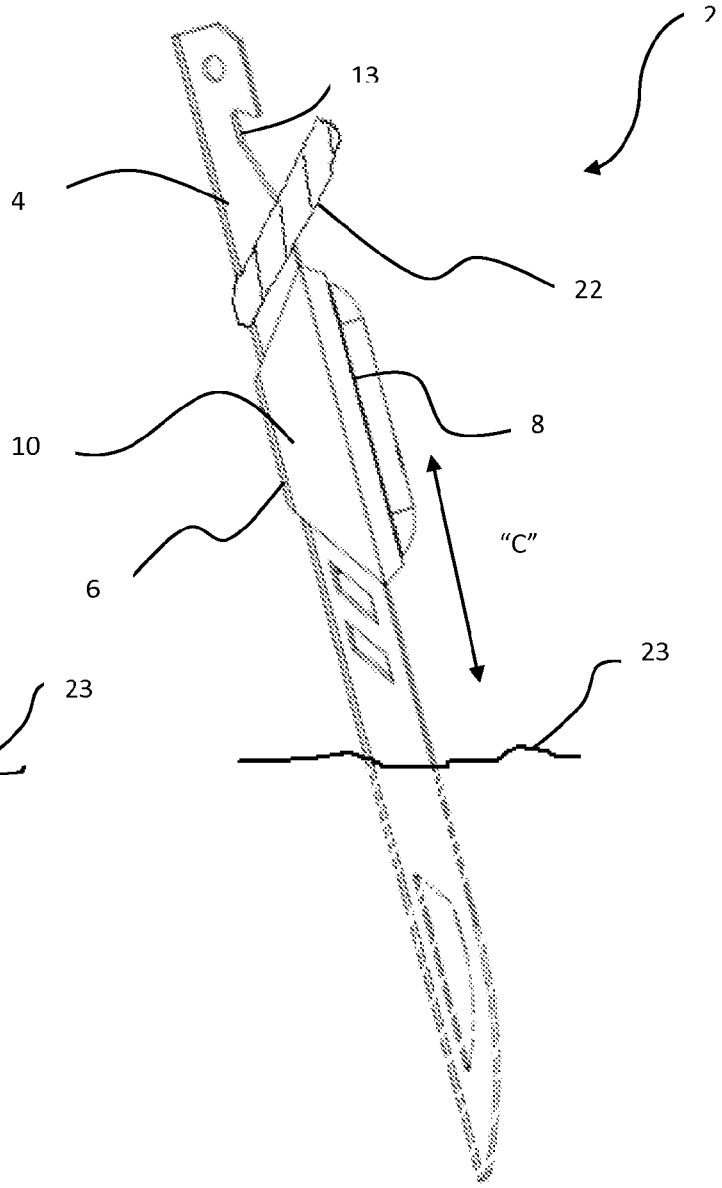
FIG. 6*a* is a right side view of the tent stake of FIG. 1, showing the tent stake driven into a ground surface, and a fastening cord attached to the tent stake, such as, for example, a rope, having an end-loop that is looped around the tent stake and hooked or retained within a lower holding notch section of the tent stake.
Figure 7:
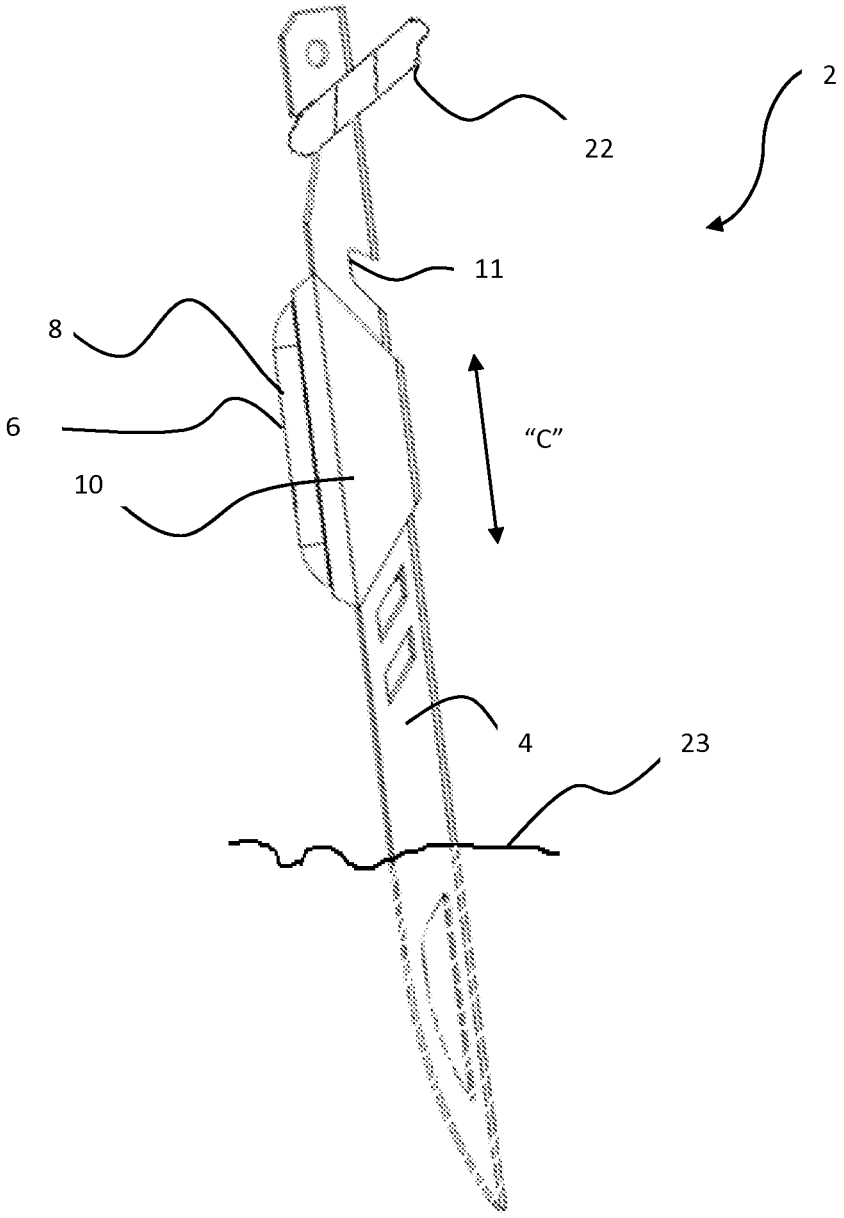
FIG. 7 is a left side view of the tent stake of FIG. 1, showing a fastening cord, such as, for example, a rope, having an end-loop that is looped around the tent stake and disposed within an upper holding notch section of the tent stake.

Referring to FIGS. 6*a*, 6*b*, and 7, in some embodiments, during use, the tent stake 2 can be driven into a ground surface 23, and a cord 22, or other flexible fastening member, can extend from a tent (not shown in the figures) to the tent stake 2, to be attached, or hooked, on the tent stake 2 to provide tension to the cord, by being looped about the tent stake body 4, and hooked, or otherwise retained, within an opposite facing lower notch section 11, or upper notch section 13, as will be appreciated by those skilled in the art after reviewing this disclosure.

For example, as shown in FIGS. 6*a* and 6*b*, in some embodiments, when the lower notch section 11 is faced opposite a tent, the lens 8 of the lighting component 6 can face the tent. The tent (not shown in the drawings), is located in the direction from which the fastening cord 22 extends toward the tent stake 2. In this position, a user can depress the lens 8, and activate the LED to provide lighting to the tent with the lens 8 directly facing the tent, such as, for example, in a continuous light mode, or flood mode. In another example, as shown in FIG. 7, when the upper notch section 13 is facing opposite the tent, the lens 8 of the lighting component can also face away from the tent. In this position, a user can depress the lens 8, and activate the LED while the lens is facing away from the tent, such as, for example, in an LED flashing mode (or flood mode, if desired by a user), which can be useful for locating the tent in the dark, as will be appreciated by those skilled in the art after reviewing this disclosure.

Referring to FIGS. 6*a* and 6*b*, in some embodiments, a user may slide the lighting component 6 (or housing 10) in the directions corresponding to arrows "C." As best seen in FIG. 6*b*, a user may slide the lighting component 6 up toward a top portion of the tent stake 2, to be snuggly retained on a top end portion of the tent stake 2, so that the tent stake 2 may be driven deeply into the ground 23 without abutting against the lighting component 6. For example, in regular use, or during storage or transportation, a user may not want to position the lighting component 6 near an end portion of the tent stake, but may do so when the tent stake needs to be driven into the ground deeply, such as, in loosely packed ground. Sliding the lighting component 6 back downward on the tent stake body 4 provides for compact storage and can avoid the lighting component 6 sliding off, unless a stop feature is provided on the tent stake to prevent the lighting component 6 from sliding off the top end portion of the tent stake body 4.

Figure 8:
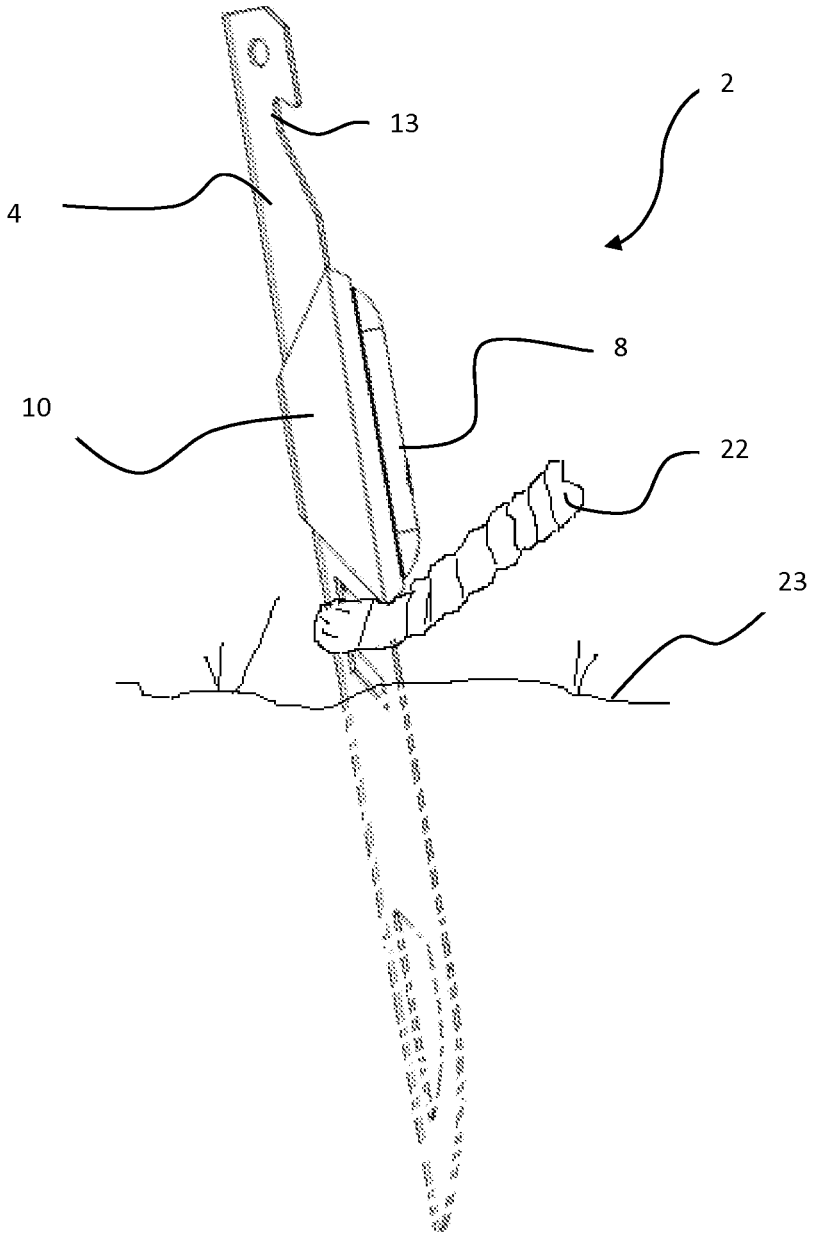
FIG. 8 is a right side view of another embodiment of the tent stake of FIG. 1, having only a front facing notch section on the body portion, showing the tent stake driven into a ground surface, and a fastening cord attached to the tent stake, such as, for example, a rope, having an end-loop that is looped around the tent stake and hooked or retained on laterally extending edges of the housing of the lighting component.

Referring to FIG. 8, in some embodiments of the present disclosure, only one notch section is provided on a single face, such as notch section 13, on the front side of the tent stake 2. However, in such embodiments, a user can still retain a tent cord 22 under tension on an opposite side of the notch section 13, on the back side of the tent stake 2, such as by, for example, placing the cord 22 (cord loop) wrapped about the tent stake 2 below the housing 10 of the lighting component, and allowing the cord 22 to abut against laterally extending lower edges 10' of the housing 10 (See, e.g., FIGS. 4 & 8). In some embodiments, even though the laterally extending edges 10' may be narrow (e.g., less than ½ cm, or ¼ cm), since the housing 10 is made of non-slick thermoplastic rubber or elastomer, friction between the cord 22 in tension and the housing can be sufficient to retain the cord from slipping away from, or past, the laterally extending edges 10'. In other embodiments, the lateral edges 10' are wider than ½ cm. Also, in some embodiments, no notch sections are provided on the tent stake body 4, either forward facing or backward facing, and the laterally extending edges 10' of the housing 10 may be used to retain a cord 22 with the tent stake facing in either direction. Although the housing can be manually slidable, when the cord abuts against the housing, and the cord is in tension, since it is not parallel to the body portion 4, only some component of the tension in the cord may be directed upward along the body portion 4 so that most of, or a substantial portion of, the force the cord exerts is not directed toward pushing the housing 10 upward. Furthermore, referring to FIG. 8, the cord tension may cause some compression of the housing against the body portion 4, thus also prevent the housing 10 from sliding when used to abut against the cord.

Figure 9:
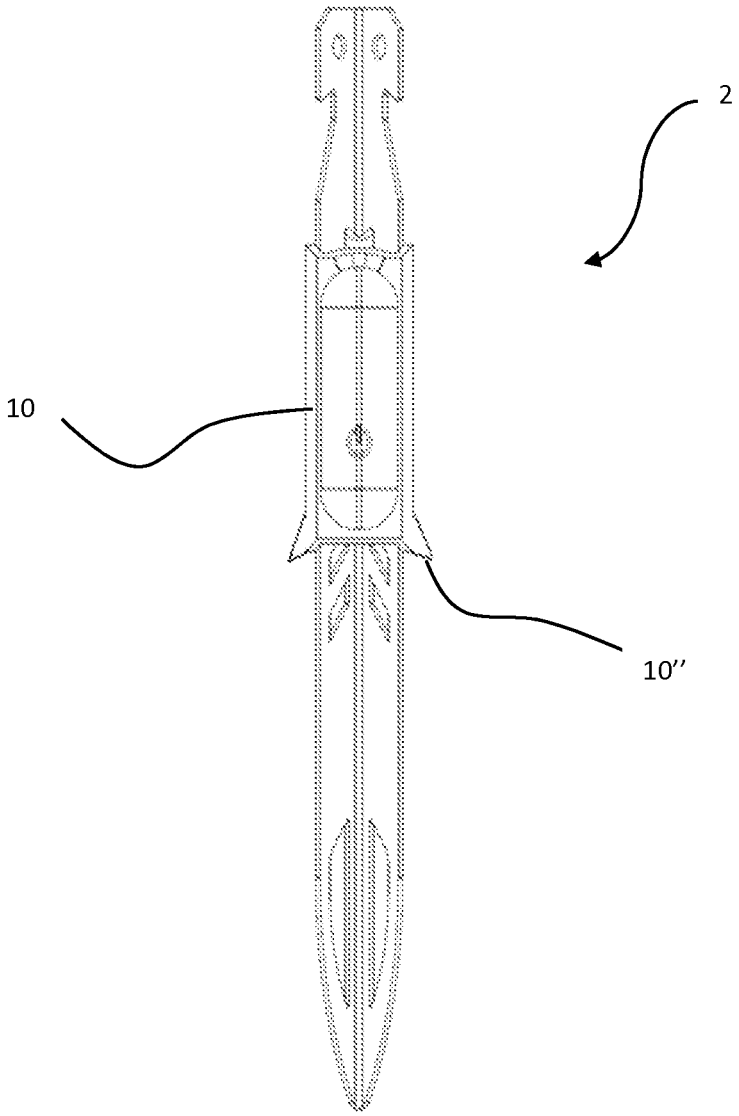
FIG. 9 is a front elevation view of another embodiment of the tent stake of FIG. 1, having hooks or notch sections provided on, or formed integral with, the housing for the lighting component.

Referring to FIG. 9, in some embodiments of the present disclosure, hooks or notch sections can be provided on, or formed integral with, the housing 10, for use in retaining the cord 22. For example, as shown in FIG. 9, a hook structures 10" can be provided on either side of the housing 10. In other embodiments, a hook (not shown in the drawings) could be formed on the back side of the housing 10, extending directly backward away from the center line of the body portion 4, as will be appreciated by those skilled in the art after reviewing this disclosure. In some embodiments, no notches are provided on the body portion 4, for use in combination with the hook structures 10" on the housing 10, and the tent stake 2 could be used to retain the cord using only the housing 10 for the lighting component, with the tent stake facing toward or away from, the tent.

Although specific embodiments of the present disclosure have been described supra for illustrative purposes, various equivalent modifications can be made without departing from the spirit and scope of the disclosure, as will be recognized by those skilled in the relevant art after reviewing the present disclosure. The various embodiments described can be combined to provide further embodiments. The described structures and methods can omit some elements or acts, can add other elements or acts, or can combine the elements or execute the acts in a different order than that illustrated, to achieve various advantages of the disclosure. These and other changes can be made to the disclosure in light of the above detailed description.

In general, in the following claims, the terms used should not be construed to limit the disclosure to the specific embodiments disclosed in the specification.

What is claimed is:

1. A tent stake, comprising:

an elongated body portion having a pointed end section for use in insertion of the tent stake into a ground surface; and a lighting component disposed between interior surfaces of a wall of the elongated body portion and attached to the body portion by a deformable spring housing that is slidably wrapped about an exterior surface of the wall of the elongated body portion, wherein a lens of the lighting component is attached to and floats on the deformable spring housing proximate to a switch of a light source disposed beneath the lens and wherein the lens can be manually pressed to activate the light source, and wherein the deformable spring housing can return the lens to an original resting position after being pressed.

2. The tent stake of claim 1, wherein the lighting component is selectively movable along a length of the body portion by sliding the deformable spring housing against the exterior surface of the wall of the body portion with a battery cover simultaneously sliding against an interior surface of the wall of the body portion.

3. The tent stake of claim 1 wherein the wall of the elongated body portion includes at least two longitudinally extending wall sections, the wall sections being joined at inward lateral edge portions thereof and forming an angle relative to one another, with at least one of the longitudinally extending wall sections forming the exterior surface of the wall and with at least part of a battery of the lighting component resting between the longitudinally extending wall sections and wherein the lighting component is moveable along a length of the body portion by manually sliding the deformable spring housing longitudinally along the exterior surface of the wall while simultaneously causing the battery to move longitudinally between the longitudinally extending wall sections.

4. The tent stake of claim 3 wherein the deformable spring housing is constructed of an elastomeric material.

5. The tent stake of claim 1 wherein the lighting component further includes a battery cover disposed between a battery of the lighting component and the elongated body portion, and wherein the wall of the body portion is snuggly and slidably fit between the deformable spring housing and the battery cover.

6. The tent stake of claim 1 wherein the elongated body portion has at least one notch section on a front side of the elongated body portion on a perimeter lateral edge of the wall of the body portion, and at least one notch section formed on a back side of the elongated body portion on an interior portion of the wall of the body portion.

7. The tent stake of claim 6 wherein the lens of the lighting component is disposed on the front side of the body portion.

8. A. tent stake comprising:

an elongated body portion having two adjacent longitudinal walls joined at an angle;

a lighting component having a battery at least partially disposed between inner surfaces of the adjacent longitudinal walls, with a lens of the lighting component and the battery both attached to a deformable spring housing that is slidably attached to and wraps about an outer surface of the longitudinal walls of the elongated body portion.

9. The tent stake of claim 8 wherein the lens of the lighting component is movable between a resting position and an actuating position to actuate a switch to supply power to a light source of the lighting component.

10. The tent stake of claim 9 wherein the housing is constructed of an elastomer, and wherein the battery provides power to the light source, and wherein a longitudinally extending gap is provided between a battery cover and the housing, and wherein the body portion is snugly fit through the longitudinal gap.

11. The tent stake of claim 10 wherein the lens is attached to the battery cover, and a ridge portion of the housing is disposed between the lens and the battery cover.

12. The tent stake of claim 8 wherein a notch section is provided on a front face of the body portion and a notch section is provided on a back face of the body portion.

13. A method for illumination using a tent stake, the tent stake having an elongated body portion and a lighting component, the lighting component having a lens proximate to a switch, the lens being depressible for activating the switch, the lighting component, including the lens, being slidably attached to the elongated body portion by a deformable spring housing that wraps about the elongated body portion and slidable along a length of the body portion, the method comprising the following steps, not restricted by order of presentation:

driving the tent stake into a ground surface;

attaching a cord to the tent stake and placing the cord under tension while retaining the cord in a position on the body portion by abutting the cord against a notch in the body portion; and depressing the lens of the lighting component from a resting position to an actuating position to actuate the switch to supply power to a light source.

14. The method of claim 13 further comprising sliding the lens from a first position on the body portion to a second position on the body portion, and retaining the cord in position against the tent stake by abutting the cord against an edge of the deformable housing to which the lens is attached.

15. The method of claim 13 wherein the cord is attachable to a tent and wherein the lens is able to face away from the tent while the elongated body portion is retaining the cord.

16. The method of claim 13 wherein the cord is attachable to a tent and wherein lens is able to face toward the tent while the elongated body portion is retaining the cord.

17. The method of claim 16 wherein at least a portion of the body portion is snuggly fit between a battery cover of the lighting component and the deformable housing of the lighting component.

* * * * *